United States Patent [19]

McElroy

[11] Patent Number: 5,036,994

[45] Date of Patent: Aug. 6, 1991

[54] INTEGRATED CONTAINER/LID ASSEMBLY

[76] Inventor: Steven G. McElroy, 3030 McKinney #906, Dallas, Tex. 75204

[21] Appl. No.: 440,095

[22] Filed: Nov. 22, 1989

Related U.S. Application Data

[63] Continuation-in-part of Ser. No. 244,626, Sep. 12, 1988, Pat. No. 4,901,881, which is a continuation of Ser. No. 107,371, Oct. 9, 1987, abandoned.

[51] Int. Cl.[5] ..... B65D 51/00

[52] U.S. Cl. ..... 220/212; 220/260; 215/228; 215/232; 215/305; 215/317

[58] Field of Search ..... 220/212, 260, 287, 306, 220/356, 359; 215/1 R, 228, 232, 305, 317, 318, 321; 150/154

[56] References Cited

U.S. PATENT DOCUMENTS

| | | | |
|---|---|---|---|
| 2,080,108 | 5/1937 | Brandstein | 215/321 |
| 2,941,691 | 6/1960 | Weinberg . | |
| 3,126,444 | 3/1964 | Taylor . | |
| 3,386,609 | 6/1968 | Eurey . | |
| 3,412,890 | 11/1968 | Rich . | |
| 3,421,654 | 1/1969 | Hexel . | |
| 3,862,614 | 1/1973 | Kovac | 215/317 |
| 4,164,303 | 8/1979 | Waterbury . | |

*Primary Examiner*—Stephen Marcus
*Assistant Examiner*—Nova Stucker
*Attorney, Agent, or Firm*—David H. Judson

[57] ABSTRACT

An integrated assembly is described comprising a container and an elastic container lid. The container has an opening wall defining an opening of the container, with the opening wall having an outer peripheral surface. The elastic container lid is stretchably adjustable to cover the opening of the container, and includes a closure panel having a peripheral edge. According to the invention, a suitable adhesive is located along a predetermined portion of the outer peripheral surface of the opening wall of the container for securing a predetermined portion of the peripheral edge of the elastic container lid to the container. When the predetermined portion of the elastic lid is secured to the container in this manner, a free portion of the elastic container lid is foldable into a first portion leaving the opening of the container substantially unsealed, a second position leaving the opening of the container partly sealed and a third position wherein the container opening is sealed. A tab is attached to the closure panel for selectively moving the free portion of the container lid between the first, second and third positions.

10 Claims, 4 Drawing Sheets

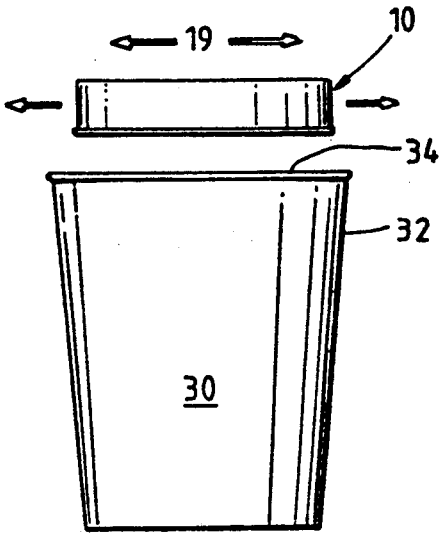
Fig. 7
Fig. 8
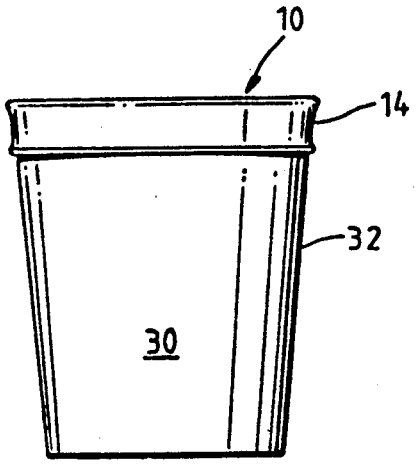
Fig. 9
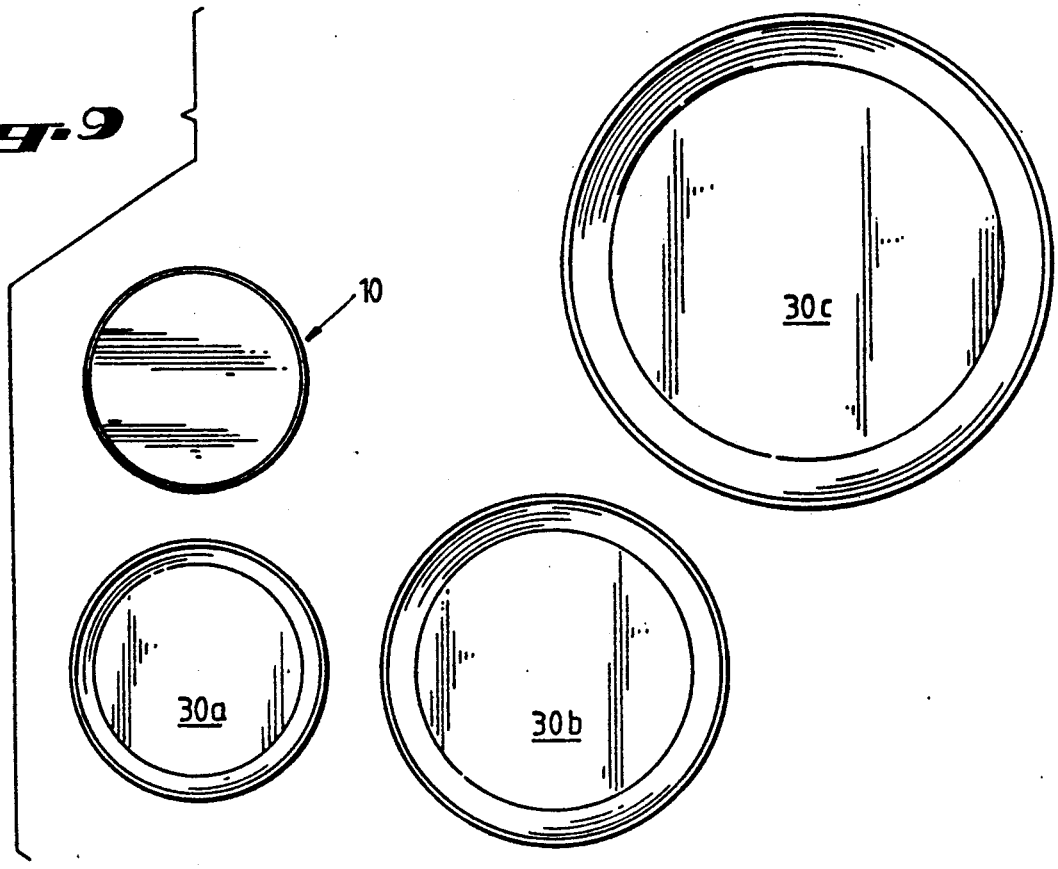

INTEGRATED CONTAINER/LID ASSEMBLY

This application is a continuation-in-part of prior copending application Ser. No. 07/244,626, filed Sept. 12, 1988, now U.S. Pat. No. 4,901,881, which was a continuation of prior application Ser. No. 107,371, filed Oct. 9, 1987, now abandoned.

TECHNICAL FIELD

The present invention relates generally to closures for containers and more specifically to an integrated container and elastic lid assembly.

BACKGROUND OF THE INVENTION

Numerous attempts have been made to provide simple and effective lids or other closures for containers. For example, paint cans typically include a concave annular ring into which is fit a lid having a convex annular ring shaped and sized such that the two rings mate to form a seal. While this type of lid provides a sturdy, durable means of closing a paint can, it suffers the disadvantage of allowing the passage of air into the paint if any material becomes trapped between the lid and the can such that a complete seal is prevented. Since paint often collects in the concave annular ring, this type of lid also leads to the splattering of paint when the lid is hammered back into place after painting.

Perhaps the greatest problems with lids are encountered with lids for disposable containers such as cups at convenience stores or fast food restaurants. Since there are a wide variety of sizes of such containers, the convenience store or fast food restaurant must presently stock a wide variety of sizes of lids to correspond with the variously sized openings of the containers. In practice, the selection of the proper lid and the placement of the lid on the container is often time consuming and, when rushed, can lead to improper installation of the lid, and leakage and even damage to the container.

It is therefore desirable to provide a method and apparatus for closing such containers which is rapid, simple, and which solves the inventory problems presented by current closure devices.

BRIEF SUMMARY OF THE INVENTION

It is an object of the present invention to provide an integrated container/lid assembly that overcomes the problems associated with prior art closure devices, especially when such devices are used in conjunction with disposable containers such as beverage containers having varying sized openings.

According to the preferred embodiment of the invention, an integrated assembly comprises a container and an elastic container lid. The container has an opening wall defining an opening of the container, with the opening wall having an outer peripheral surface. The container may be rigid or non-rigid. Preferably, the elastic container lid is stretchably adjustable to cover the opening of the container, and includes a closure panel having a peripheral edge. The peripheral edge may include a suitable annular bead. According to the preferred embodiment, a suitable adhesive, e.g., a glue strip, is located along a predetermined portion of the outer peripheral surface of the opening wall of the container for securing a predetermined portion of the peripheral edge of the elastic container lid to the container. When the predetermined portion of the elastic container lid is secured to the container in this manner, a free portion of the plastic container lid is foldable into essentially three (3) positions.

In a first or "fully-open" position, the opening of the container is substantially unsealed, thereby enabling the container to be filled. In a second or "partly-closed" position, the opening of the container is partly sealed. This position is especially suitable for use when the user does not desire to use a straw or the container is filled with a hot beverage. In a third or "fully-closed" position, the lid is stretched over the entire container opening to seal the container. A tab or other gripping element is attached to the closure panel for selectively moving the free portion of the container lid between the first, second and third positions.

In an alternate embodiment, the elastic lid is attached to the lip of the container directly by heat-sealing or other non-adhesive means or methods of manufacture. Alternatively, the lid is integrally-formed with the container itself or mechanically-secured thereto to obviate the use of separate adhesive.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

This invention will be further illustrated by reference to the appended drawings which illustrate particular preferred embodiments of the lid and container constructed in accordance with the present invention.

FIG. 2 is also a top view of the lid shown in FIGS. 3–6;

FIG. 7 is a side view of a container and lid constructed in accordance with the present invention in which the lid is shown in an unstretched position before application to the container;

FIG. 8 is a side view of the container shown in FIG. 7 with the lid stretched and installed in place on the container;

FIG. 9 is a plan view of a lid of the present invention and three differently sized containers illustrating the relative dimension of the lid in relation to such differently sized containers;

Similar reference characters refer to similar parts throughout the several views of the drawings.

DETAILED DESCRIPTION

The basic concept of the present invention is the provision of a lid which is made of an elastomeric material or other material that is resiliently stretchable to fit a fairly wide range of container openings. The primary application for such a lid is for closing the disposable cups typically found in fast food restaurants and in convenience stores. For these uses, since the lid is a "one-size-fits-all" lid, the lid solves the significant inventory problems which such businesses face. For fast food restaurants, the lid further offers the advantage of being easily applied to a disposable cup, thereby simplifying and expediting the process of handling beverages at the restaurants.

It has been found, however, that such a lid has other applications. For example, the lid may be used for a variety of sizes of food and beverage containers such as TUPPERWARE containers. The lid is also suitable for providing a quick, overnight seal for paint cans once the conventional cans have been opened. These and other advantages provided by the methods and apparatus of the present invention will become more apparent in view of the following disclosure.

Figure 1:
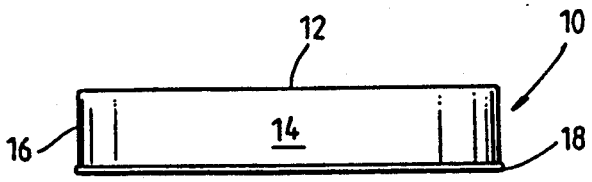
FIG. 1 is a side view of the preferred embodiment of a lid constructed according to the present invention.
Figure 2:
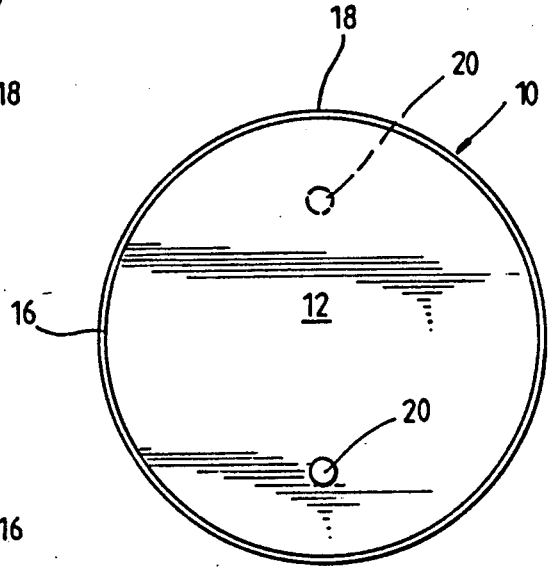
FIG. 2 is a top view of the lid shown in FIG. 1.

Referring now to FIGS. 1 and 2, the preferred embodiment of the present invention is shown. The lid 10 includes a closure panel 12 and a gripping zone 14 located along the periphery of the closure panel 12. The lid may be made of a number of materials which are resiliently stretchable to provide adjustability of the lid to cover a selected range of container openings. Since the lid 10 is affixed to a container utilizing the resiliency of the lid to draw the lid around the container, the closure panel is typically selected to be smaller in dimension in an unstretched condition than the smallest of the anticipated container opening sizes so that the closure panel must be stretched to cover the smallest of such known container openings in use.

In turn, the gripping zone 14 must also be outwardly adjustable to surround the container walls which define a container opening. The gripping zone 14, therefore, is also typically made of a material which is resiliently stretchable such that the gripping panel may be stretched outwardly to surround a container wall and such that the gripping zone will tend to contract to an unstretched position to engage the container wall and hold the lid to the container.

Accordingly, the lid 10 may be made of an elastomeric material having the property of being resiliently stretchable for the anticipated range of lids. In the preferred embodiment, the closure panel 12 and gripping zone 14 are typically comprised of an elastomeric material. In a presently most preferred embodiment, the lid is comprised of a latex material which is commonly called Natural Rubber Latex. or Hevea Latex which has a chemical designation of CIS-1,4 polyisoprene.

Referring again to FIGS. 1-6, the closure panel 12 and gripping zone 14 may be formed in a number of shapes. In the preferred embodiment shown in FIGS. 1 and 2, the closure panel 12 has a substantially circular cross-section. The gripping zone includes an annular skirt 16 extending transversely to the closure panel 12. The gripping zone further includes an annular bead 18 disposed around the periphery of annular skirt 16 to further reinforce the gripping aspect of the gripping zone. In particular, the annular bead 18 often serves to restrict the outward expansion of the annular skirt 16 and to increase the inward force exerted by he annular skirt 16 on the container walls to ensure suitable gripping by the gripping zone 14 of a container in use. In the preferred embodiment, the annular bead 18 is formed form part of the annular skirt 16 by rolling the edge of the annular skirt 16 to form an annular rib or bead 18 as shown.

Figure 3:
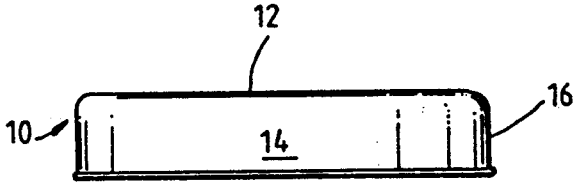
FIG. 3 is a side view of an alternative embodiment of a lid constructed in accordance with the present invention.

Referring now to FIGS. 3-6, there are shown alternative embodiments of a lid 10 constructed in accordance with the present invention. FIG. 3 shows an embodiment in which the definition between the closure panel 12 and the annular skirt 16 is less clearly defines than shown for the preferred embodiment in FIG. 1. That is, the closure panel 12 gently rounds into the annular skirt 16 as shown in FIG. 3.

Figure 4:
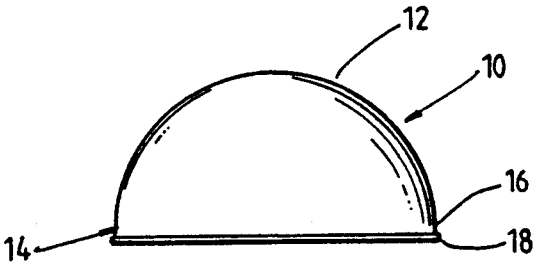
FIG. 4 is a side view of another alternative embodiment of a lid constructed in accordance with the present invention.

Referring now to FIG. 4, the lid may alternatively have a domed shape in the unstretched position. When the embodiment shown in FIG. 4 is used, it has been found that part of the sides of the dome effectively form an annular skirt as designated by 16 when the lid is stretched outwardly over a container opening with the remaining portion of the lid forming the closure panel as designated by 12. In turn, the stretching of the lid 10 to cover container openings typically flattens the closure panel 12 such that the closure panel is substantially planar in the stretched condition despite its domed shape in the relaxed condition.

Figure 5:
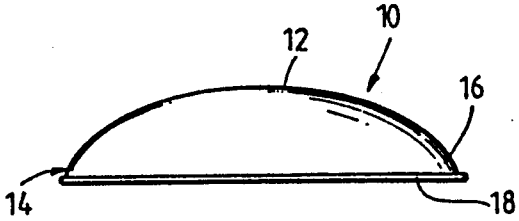
FIG. 5 is a side view of another alternative embodiment of a lid constructed in accordance with the present invention.
Figure 6:
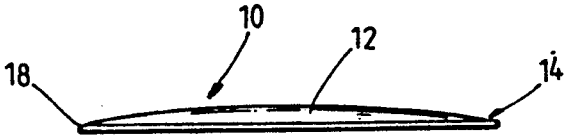
FIG. 6 is a side view of another alternative embodiment of a lid constructed in accordance with the present invention.

FIG. 5 shows a variation of the domed shape lid shown in FIG. 4. In the embodiment shown in FIG. 5, less of the walls of the dome will form a gripping zone and the majority of the dome will form the closure panel 12. In the embodiment shown in FIG. 6, the gripping zone is effectively represented by the annular bead 18.

Hence, in accordance with the present invention, the gripping zone of the lid 10 may be formed to either of an annular skirt, or an annular bead, or may include both an annular skirt and an annular bead. Moreover, the gripping zone 14 may extend transversely from the closure zone 12 as shown in FIG. 1 or may simply extend from the periphery of the closure panel 12 as shown in FIGS. 4 and 5.

Referring now to FIGS. 7 and 8, the container constructed in accordance with the present invention is shown. The container 30 may comprise any of a number of known containers for holding solid or liquid materials. In the preferred embodiment, the container is typically comprised of a disposable cup such as found in fast food restaurants or in convenience store locations. The container 30 includes a lid 10 which is resiliently stretched over the container opening such that the gripping zone 14 of the lid 10 is engaged with a container wall 32 defining a container opening 34 at the top of the container 30. The lid 10 is resiliently stretched over the container opening 34 and the lid is released so that the resiliency of the lid 10 engages the lid in position over the container opening 34.

The present invention also provides a method for supply beverages and disposable containers. The method includes the steps of providing disposable containers 30 in which some containers have an opening 34 of one size defined by an opening wall 32 and in which some containers have an opening 34 of a different size defined by an opening wall 32. The method further includes the step of providing lids 10 of a single size for the containers, with each lid being of an elastic material which retains its elasticity during use and each lid comprising a closure panel 12 and a gripping zone 14 along the periphery of the closure panel wherein the lid is stretchable for engaging the gripping zone with the opening wall of either size opening to seal the opening.

In yet another method of the present invention, a method of dispensing beverages and container having a plurality of differently sized openings is provided. Referring to FIGS. 7 and 8, the method includes the steps of dispensing a beverage into such a container 30, using lids of a single size for all of the containers, each lid being of an elastic material which retains is elasticity during use. Each lid 10 has a closure panel 12 with a gripping zone 14 along its periphery. The method further includes the step of resiliently stretching such a lid 10 as shown in FIG. 7 outwardly over the container opening, engaging the gripping zone 14 about the opening as shown in FIG. 8, and releasing the resiliency of the lid 10 to engage the lid 10 in position over the container opening 34.

The present invention still further provides a method of making a lid for use in closing container openings on a range of disposable containers having openings of different sizes wherein the container openings are defined by a container wall. The method comprises the steps of selecting an elastic material and forming the lid out of the elastic material with a closure panel 12 and a gripping zone 14 along the periphery of the closure panel 12. The lid is made of a size smaller than the smallest anticipated container opening size so that the lid 10 must be resiliently stretched to be fitted over any container openings 34 for the resiliency of the lid 10 to keep it engaged with any of the containers 30 over such an opening 34. In this method, the size of the lid and the elasticity of the material are selected in relation to the sizes of the openings and the crush strength of the container walls so that the elasticity or resiliency of the material of the lid will be sufficient to provide the sealing engagement of the lid with any of the disposable containers. At the same time, the inward force exerted by the resiliency of elasticity of the lid must not be so great as to cause crushing of the containers when the lid is mounted onto the container.

In the preferred embodiment, the lid is adapted for use with disposable containers typically found in fast food restaurants and convenience stores. It has been found that the anticipated sizes for such containers range from approximately three inches to approximately six inches. The closure panel 12 of the lid is then selected to be approximately two and one-half inches in diameter such that the lid must be stretched approximately one-half inch to cover the smallest container and must be stretched approximately three and one-half inches to cover the largest container. Referring to FIGS. 1 and 2, in the preferred embodiment, the annular skirt 16 has a width of approximately one fourth inch and the annular skirt 16 includes an annular bead 18 which is a rolled rib around the periphery of the annular skirt 16. As stated above, the lid is comprised of natural rubber latex or Hevea latex having a chemical designation of CIS-1,4 polyisoprene. It has been found that lids having a thickness of two thousandths 0.002) of an inch to eight thousandths 0.008) of an inch would provide the requisite elasticity, stretch, and strength to expand to cover the selected container sizes (a representation of which are shown in FIG. 9 as containers 30 a–c), without crushing the disposable containers.

Referring again to FIG. 2, each of the lids shown in FIGS. 1–6 may further include an aperture means for receiving a drinking straw. As shown in FIG. 2, the aperture means 20 may either include a hold stamped into the lid which is sized to snugly receive such a straw when the closure panel 12 is in a stretched position. the aperture means may alternatively include a weakened or perforated portion (as shown by the dashed lines) which may be removed by the user of the lid when inserting the straw. In either case, the aperture means is preferably sized to snugly receive the straw when the closure panel is stretched in order to minimize leakage of fluid from the beverage container when the straw is inserted.

Figure 10:
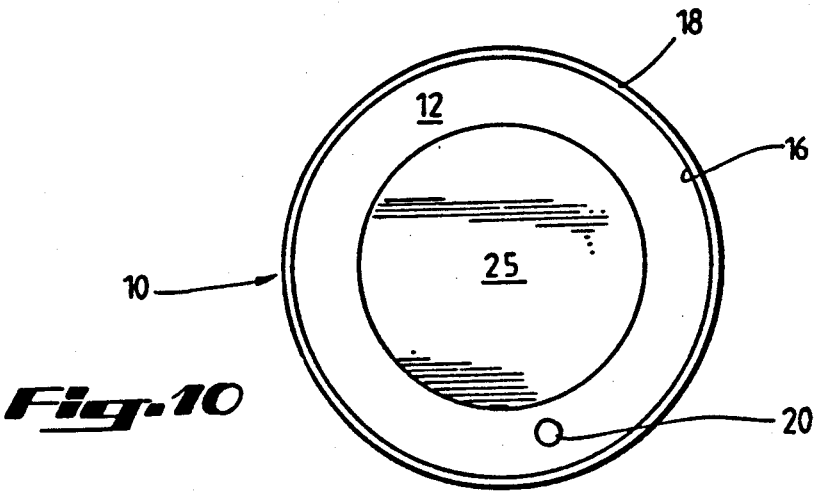
FIG. 10 is a top view of a lid constructed in accordance with the present invention in which only the periphery of the closure panel of the lid is constructed of elastomeric material.
Figure 11:
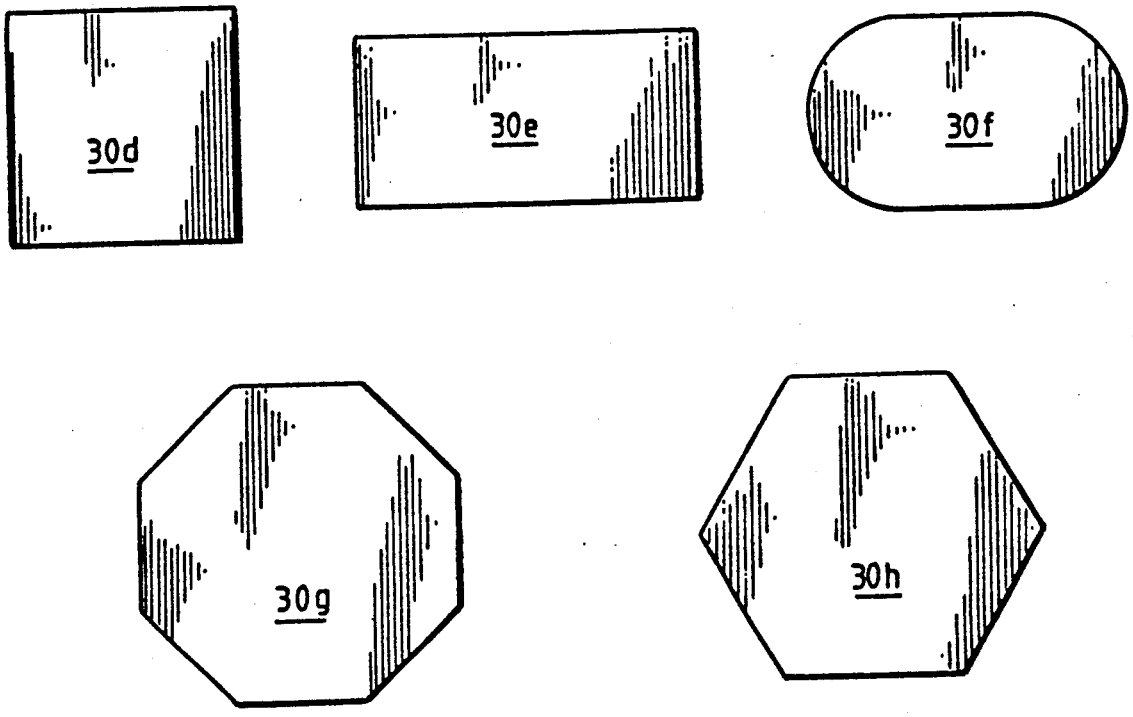
FIG. 11 is a top view of various other container openings which are suitable for use in accordance with the present invention.

Referring now to FIG. 10, there is shown an alternative embodiment of the present invention. In the embodiment shown in FIG. 10, the closure panel 12 includes a non-plastic region 25. The non-elastic region 25 may comprise a variety of shapes, including ornamental shapes for displaying trademarks or logos of different businesses. In this embodiment of the present invention, the elasticity or stretch is provided around the periphery of the non-elastic zone 25. It will be appreciated in view of the above disclosure that the non-elastic zone 25 will limit the range of adjustability of the lid 10 shown in FIG. 10.

According to an alternate embodiment of the invention, it is desirable to combine the elastic container lid and the container to form an integrated assembly. This embodiment is especially desirable in connection with the dispensing of beverages at fast-food or convenience stores because the integrated container/lid assembly is simple and inexpensive to manufacture and obviates the application of the lid to the container at the point-of-sale. Referring now simultaneously to FIGS. 12–17, various top and side views are shown of this alternate embodiment of the invention.

In particular, the assembly 50 comprises the container 52 and the elastic container lid 54 suitably affixed or otherwise secured thereto. The container shown in FIGS. 12–17 is a non-rigid disposable container of the type conventionally-used in fast-food or convenience stores, but it should be expressly understood that the principles of the integrated container/lid assembly shown in FIGS. 12–17 are fully applicable to rigid containers as well. The container 52 has an opening wall 56 defining an opening 58 of the container, and the opening wall 56 has an outer peripheral surface 60. The container 52 may also include a lip 62 although not required. The elastic container lid 54 is of the type generally described above and is adapted to be stretchably adjustable to cover the opening of the container. As described above, the lid 54 includes a closure panel 64 (which is obscured in FIGS. 12–13 but is seen in FIGS. 14–17), the closure panel having a peripheral edge 66. As shown in the figures, the peripheral edge 66 includes an annular bead, although this construction is not meant to be limiting.

Figure 12:
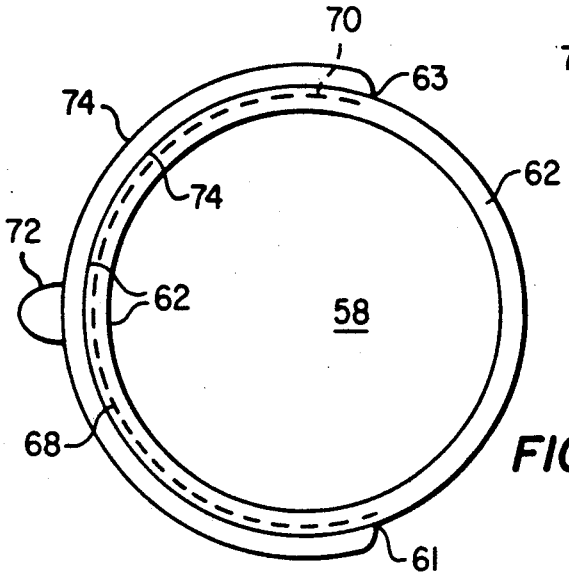
FIG. 12 is a top view of an alternate embodiment of the invention wherein the elastic container lid is affixed to the container and with the lid being in a first or "fully-open" position.
Figure 13:
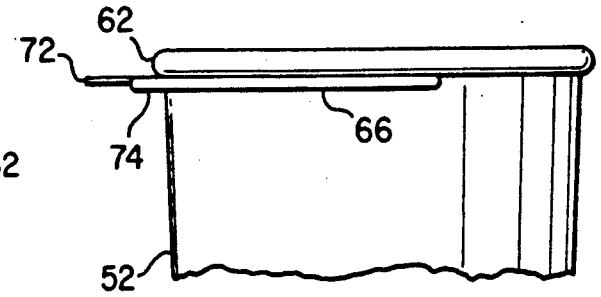
FIG. 13 is a elevational view of the integrated container/lid assembly of FIG. 12 with the lid being in the fully-open position.

According to the invention, preferably a portion of the outer peripheral surface 60 of the opening wall 56 includes an attaching means, for example, an adhesive or glue strip, shown in phantom and designated by the reference numeral 68. As seen in FIG. 12, the glue strip preferably extends along a predetermined portion, approximately 180 degrees (or one-half), of the entire outer peripheral surface of the opening wall of the container for securing a corresponding portion 70 of the peripheral edge 66 of the plastic container lid to the container. The assembly further includes a pull tab 72 or the like attached to the lid for the purposes to be described.

When the predetermined portion of the elastic container lid 54 is secured to the container 52 a free portion 74 of the elastic container lid 54 is created. The pull tab 72 is attached to this free portion and thus the free portion of the lid is foldable into essentially one of three fixed positions. In a first or "fully-open" position shown in FIGS. 12–13, the opening 58 of the container 52 is substantially unsealed, thereby enabling the container to be filled. In the preferred embodiment, the integrated assembly 50 is provided to the end-user (i.e., the fast-food or convenience store) with the lid in the fully-open position. This enables the assembly to be placed under an ice and/or beverage dispenser for filling of the container.

Figure 14:
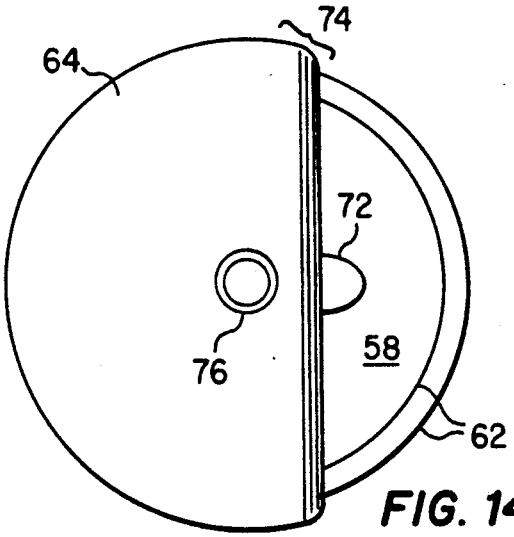
FIG. 14 is a top view of the integrated container/lid assembly with the lid in a second or "partly-closed" position.
Figure 15:
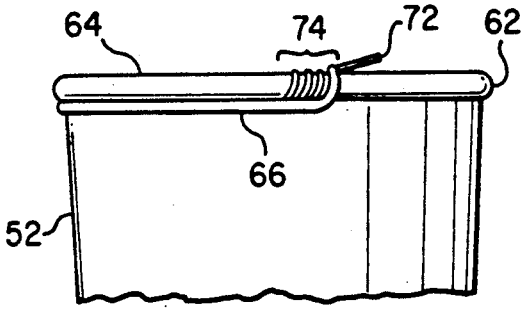
FIG. 15 is an elevational view of the assembly of FIG. 14 with the lid being in the partly-closed position.

In a second or "partly-closed" position shown in FIGS. 14–15, the opening 58 of the container is partly sealed. This position is especially suitable for use when the user does not desire to use a straw or the user desires to have a "sipping" hole for sipping a hot beverage such as coffee supported in he cup. The partly-closed position also can be used under an ice machine if the cup is filled only with the beverage when in the fully-open position. The second position is effected by the user lifting the pull tab 72 up and over the lip of the container after the container is filled with a beverage. After the free portion of the lid "clears" the lip, the pull tab 72 is either left in the position shown in FIG. 14 or is pulled back over portion of the lid affixed to the container.

Figure 16:
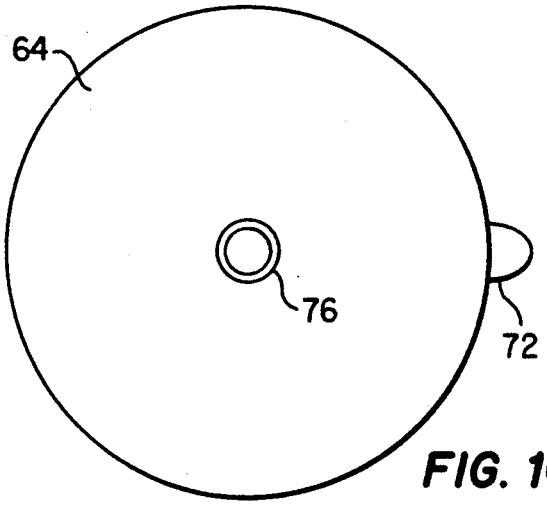
FIG. 16 is a top view of the integrated container/lid assembly with the lid in a third or "fully-closed" position.
Figure 17:
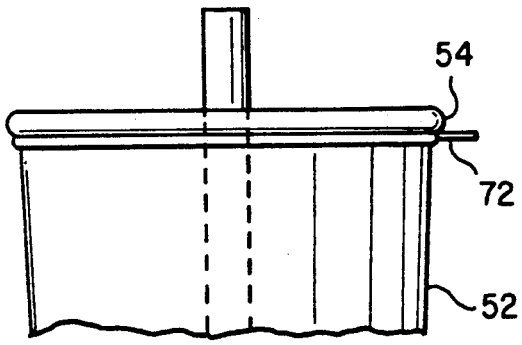
FIG. 17 is an elevational view of the integrated container/lid assembly with the lid in the fully-closed position.

In a third or "fully-closed" position as best seen in FIGS. 16–17, the lid 54 is stretched over the entire container opening 58 to seal the container 52. In this position, the user can insert a straw (not shown) through the aperture 76 in the closure panel 64 of the lid means the closure panel of the lid as previously described.

It should be appreciated that numerous modifications to the preferred embodiment of FIGS. 12–17 can be made without departing from the scope of the invention. While the adhesive is shown in FIG. 12 as extending approximately one-half way around the outer peripheral surface of the opening wall, the invention is not so limited. The lid may be affixed with two spot coatings of glue or other adhesive only at the ends 61 and 63 of the predetermined portion, or at one or more other discrete positions. Moreover, it should also be appreciated that no adhesive is required at all if the annular bead of the lid is otherwise suitably secured to the predetermined portion of the outer container wall by heat-sealing or the like. The bead can even be mechanically attached through a slit or the like in the outer container wall, or the lid and the wall (or portion thereof) can be formed as an integrated piece. The bead of the lid may, alternatively, be clipped to the cut edge.

The integrated container/lid assembly shown in FIGS. 12–17 has significant advantages. Separate inventories of containers and lids are not required. The user need not apply the lid, nor does the convenience store clerk need to be trained to do so. There is also no need for any lid-applying apparatus at the point-of-sale should manual application of the lid be undesirable for any reason. Moreover, because of the flexibility of the lid once it is affixed to the container, the lid can be placed in its partly-closed position substantially to enable the user to drink from the container without a straw, to enable the user to insert ice into the filled container, or to prevent spillage. The partly-open closed position is also highly desirable for use with hot fluids such as coffee or the like. The lid can also be opened and re-closed easily, thus making the assembly ideal for use in unstable conditions such as driving. Further, because the lid is normally not removable from the container, it cannot be reused or used for other purposes. The integrated assembly is child-proof and also reduces any litter problem associated with use of removable lids. The assembly will also advantageously speed up operations in high-volume fast-food restaurants.

Moreover, when the integrated container/lid assembly has the lid in the first or "fully-open" position, a plurality of such assemblies are readily nestable (i.e., one assembly can slide inside another assembly in a readily-stackable manner). This facilitates storage and transportation of the assemblies and use thereof in connection with conventional dispensing machines.

The integrated container/lid assembly also creates significant production advantages. As discussed above, the assembly requires only a centralized lid loading device (at the point of manufacture or assembly) and not at each point-of-sale. The integrated assembly also eliminates the concern of retaining the shape of the container lid during shipping and handling. It further enables the use of a more-stable, centralized straw hole.

According to another feature of the invention, a method for making an integrated container/lid assembly begins with the step of forming a container having an opening wall defining an opening of the container, the opening wall having an outer peripheral surface. Thereafter, a strip of adhesive (i.e., a glue strip, double-sided adhesive tape, hot-melt glue, chemically-bonded glue or other known attaching means) is applied to a predetermined portion of the outer peripheral surface of the opening wall of the container. An edge portion of an elastic container lid is then secured to the predetermined portion of the outer peripheral surface of the opening wall of the container. Alternatively, the adhesive is applied to the elastic lid instead of the container and thereafter attached to the container. When the edge portion of the plastic container lid is secured to the container in this manner, a free portion of the elastic container lid is foldable into a first position leaving the opening of the container substantially unsealed, a second position leaving the opening of the container partly sealed and a third position wherein the container opening is sealed. Although not shown specifically, the invention envisions the use of any elastic lid integrated with any type of container including, but not limited to, containers used for pre-packaged dinners or for yogurt or other semi-solid foods. Also, the invention has applicability for medical containers, crucibles, test tubes and other laboratory containers.

It should be appreciated by those skilled in the art that the specific embodiments disclosed above may be readily utilized as a basis for modifying or designed other structures for carrying out the same purposes of the present invention. It should also be realized be those skilled in the art that such equivalent constructions do not depart from the spirit and scope of the invention as set forth in the appended claims.

What is claimed is:

1. An integrated container/lid assembly, comprising a container having an opening wall defining an opening of the container, the opening wall having an outer peripheral surface;

an elastic container lid, stretchably adjustable to cover the opening of the container, and including a closure panel having a peripheral edge;

attaching means located along a predetermined portion of the outer peripheral surface of the opening wall of the container for securing a predetermined portion of the peripheral edge of the elastic container lid to the container, wherein when the predetermined portion of the elastic container lid is secured to the container a free portion of the elastic container lid is foldable into a first position leaving the opening of the container substantially unsealed, a second position leaving the opening of the container partly sealed and a third position wherein the container opening is sealed; and tab means attached to the closure panel for selectively moving the free portion of the container lid between the first, second and third positions.

2. The integrated container/lid assembly as described in claim 1 wherein the container lid includes an annular bead extending ground the peripheral edge of the closure panel.

3. The integrated container/lid assembly as described in claim 2 wherein the annular bead comprises a rolled portion of the container lid.

4. The integrated container/lid assembly as described in claim 1 wherein the closure panel of the lid includes aperture means for receiving a drinking straw.

5. The integrated container/lid assembly as described in claim 4 wherein the aperture means is sized to snugly receive the drinking straw when the closure panel is in the third position sealing the container opening.

6. The integrated container/lid assembly as described in claim 1 wherein the predetermined portion of the outer peripheral surface of the opening wall extends around substantially one-half of the outer peripheral surface.

7. The integrated container/lid assembly as described in claim 6 wherein the attaching means is a glue strip located along the entire predetermined portion of the outer peripheral surface.

8. The integrated container/lid assembly as described in claim 6 wherein the attaching means is one or more glue spots located at discrete points along the predetermined portion of the outer peripheral surface.

9. The integrated container/lid assembly as described in claim 1 wherein the container is a non-rigid, disposable container and the container opening is readily-deformable.

10. An integrated container/lid assembly, comprising:

a container having an opening wall defining an opening of the container, the opening wall having an outer peripheral surface;

an elastic container lid, stretchably adjustable to cover the opening of the container, and including a closure panel having an edge portion secured to a predetermined portion of the outer peripheral surface of the opening wall of the container, wherein when the edge portion of the elastic container lid is secured to the container a free portion of the elastic container lid is foldable into a first position leaving the opening of the container substantially unsealed, a second position leaving the opening of the container partly sealed and a third position wherein the container opening is sealed; and means attached to the closure panel for selectively moving the free portion of the container lid between the first, second and third positions.

* * * * *